US010801715B2

(12) United States Patent
Lai

(10) Patent No.: US 10,801,715 B2
(45) Date of Patent: Oct. 13, 2020

(54) LAMP WITH DRAINAGE CHANNEL

(71) Applicants: NGL GLOBAL LIMITED, N.T. (HK); Jensen-Tomy T K Lai, Madison, CT (US)

(72) Inventor: Jensen-Tomy T K Lai, Madison, CT (US)

(73) Assignees: NGL GLOBAL LIMITED, N.T. (HK); Jensen-Tomy T K Lai, Madison, CT (US)

( * ) Notice: Subject to any disclaimer, the term of this patent is extended or adjusted under 35 U.S.C. 154(b) by 0 days.

(21) Appl. No.: 16/589,366

(22) Filed: Oct. 1, 2019

(65) Prior Publication Data

US 2020/0109851 A1 Apr. 9, 2020

Related U.S. Application Data

(60) Provisional application No. 62/741,874, filed on Oct. 5, 2018.

(51) Int. Cl.
*F21V 31/00* (2006.01)
*F21K 9/20* (2016.01)
(Continued)

(52) U.S. Cl.
CPC ..... *F21V 31/005* (2013.01); *F21K 9/20* (2016.08); *F21V 21/30* (2013.01); *F21V 29/70* (2015.01);
(Continued)

(58) Field of Classification Search
CPC ..... F21W 2131/10; F21W 2131/1005; F21W 2131/101; F21W 2131/105;
(Continued)

(56) References Cited

U.S. PATENT DOCUMENTS 9,261,251 B1 * 2/2016 Ladewig ..... F21S 8/085
9,933,145 B2 4/2018 Chen et al.
(Continued)

FOREIGN PATENT DOCUMENTS

CN 203549634 U 4/2014

OTHER PUBLICATIONS

PCT/US2019/054673 International search report dated Dec. 13, 2019.

*Primary Examiner* — Robert J May
(74) *Attorney, Agent, or Firm* — WPAT, PC

(57) ABSTRACT

Provided is a lamp with a drainage channel, including an outer case, a lamp module, and a rear cover. The lamp module includes a heat dissipation case having a mounting portion, and at least one light emitting elements and a reflector are sealingly mounted in the mounting portion. The heat dissipation case other than the mounting portion is provided with one drainage hole, and the lamp module is assembled at one end of the outer case so that water or liquid penetrated into the outer case, or water condensed in the outer case can be discharged through the drainage hole. The rear cover is pivotally coupled to the other end of the outer case to close or open the other end of the outer case so as to prevent the sensitive electronic components from being exposed to the outside and not to be adversely affected by environmental factors when repairing or changing the setting of the operation mode.

8 Claims, 6 Drawing Sheets

(51) Int. Cl.

| | |
|---|---|
| ***F21V 29/70*** | (2015.01) |
| ***F21V 21/30*** | (2006.01) |
| *F21Y 115/10* | (2016.01) |
| *F21W 131/10* | (2006.01) |

(52) U.S. Cl.
CPC ..... *F21W 2131/10* (2013.01); *F21Y 2115/10* (2016.08)

(58) Field of Classification Search
CPC ..... F21W 2131/107; F21W 2131/20; F21W 2131/202; F21W 2131/205; F21W 2131/208; F21W 2131/30; F21W 2131/301; F21W 2131/302; F21W 2131/304; F21W 2131/305; F21W 2131/308; F21W 2131/40; F21V 31/00; F21V 31/005; F21V 31/03; F21V 31/04
See application file for complete search history.

(56) References Cited

U.S. PATENT DOCUMENTS

| | | | | |
|---|---|---|---|---|
| 2008/0285271 | A1 | 11/2008 | Roberge et al. | |
| 2011/0038153 | A1 | 2/2011 | Hu | |
| 2011/0273883 | A1* | 11/2011 | Tsai ..... | F21V 29/70 362/249.02 |
| 2012/0275162 | A1 | 11/2012 | Spiro | |
| 2014/0334148 | A1 | 11/2014 | Lee et al. | |

* cited by examiner

LAMP WITH DRAINAGE CHANNEL

CROSS-REFERENCE TO RELATED APPLICATION

This application claims the priority of U.S. provisional patent application No. 62/741,874, filed on Oct. 5, 2018, which is incorporated herewith by reference.

BACKGROUND OF THE INVENTION

1. Field of the Invention

The present invention relates to a lamp, in particular to a lamp that is able to discharge water or liquid penetrated into an outer case of the lamp, or water condensed in the outer case to outside the outer case, and to prevent sensitive electronic components from being exposed to the outside, thereby causing an adverse effect by environmental factors when repairing or changing the setting of the operation mode.

2. The Prior Arts

The structure of a conventional lighting lamp, especially an outdoor lighting lamp, is generally a one-piece design, that is, a lamp module is installed together with other components in a single compartment inside a single case, and is then sealed with a single gasket installed between a front cover in front of the outer case and the outer case in an attempt to prevent moisture from penetrating into the outer case.

The disadvantage of the conventional lamp is that all components (including sensitive electronic components, LED areas, etc.) in the outer case are exposed to the outside at the same time when the lamp needs to be opened due to failure, repair, periodic maintenance or changing the setting of the operation mode, so that unfavorable factors, such as moisture, in the external environment may adversely affect the electronic components and shorten the service life of the products.

SUMMARY OF THE INVENTION

The objective of the present invention is to solve the prior issue that when a conventional lamp is opened due to repair, maintenance, or changing the setting of the operation mode, all sensitive electronic components and other components disposed in the outer case are exposed to the outside at the same time, thereby causing external environmental factors to adversely affect the electronic components.

The present invention is characterized in that several components including sensitive electronic components, LEDs and the like are independently sealed into a lamp module, and the lamp module then is installed at one end of the outer case of the lamp, and at least one drainage holes are disposed at appropriate positions other than those the lamp module is sealed. According to this, the water or liquid penetrated into the outer case, or the water condensed in the outer case due to the heating and cooling of the lamp can be discharged through the drainage holes. In addition, the other end of the outer case can be easily opened or closed to facilitate the equipment installed in the outer case to be repaired, maintained or changed in the setting of the operation mode, and the interior of the lamp module is not exposed to the outside at all. Therefore, the external environment factors such as moisture, etc. will not adversely affect the interior of the independently sealed lamp module.

The present invention provides a lamp with a drainage channel, comprising: an outer case having an inner space extending through two opposite ends of the outer case; a lamp module including a heat dissipation case having a mounting portion, wherein at least one light emitting elements and a reflector are sealingly mounted in the mounting portion, the heat dissipation case other than the mounting portion is provided with at least one drainage hole, and the lamp module is assembled at one end of the outer case so that the drainage hole is communicated with the inner space; and a rear cover pivotally coupled to the other end of the outer case such that the other end of the outer case can be closed or opened by the rear cover. By separately sealing the lamp module and then mounting it on the outer case, water or liquid penetrated into the outer case, or water condensed in the outer case can be immediately discharged. Moreover, when the outer case is opened through the rear cover, the sensitive electronic components and other components in the lamp module are not exposed to the outside at all, and at the same time, it is convenient for the worker to repair, maintain or change the setting of the operation mode of the lamp.

In one embodiment of the present invention, an inner wall surface of the outer case forms at least one drainage groove that communicates with the two opposite ends of the outer case, and when the lamp module is mounted on the outer case, the drainage groove is linearly corresponding to the drainage hole, and thereby water or liquid in the outer case can flow to the drainage groove and then is discharged outside the outer case through the drainage hole.

Preferably, the heat dissipating case has a frame, and the mounting portion is located around the periphery of the frame to form a mounting space, and the drainage hole is disposed at a position adjacent to the edge of the frame.

Preferably, the drainage groove is integrally formed to be recessed toward the inner wall surface of the outer case.

In another embodiment of the present invention, the light emitting element, the reflector, a front sealing ring, a light-transparent plate and a front cover are mounted on the front side of the mounting portion, wherein the front sealing ring is urged between the light-transparent plate and the front periphery of the mounting portion and the front cover is assembled in front of the light transparent plate, and a rear sealing ring and a waterproof cover are mounted behind the mounting portion, and the rear sealing ring is urged between the waterproof cover and the rear periphery of the mounting portion. Accordingly, the front and rear of the mounting portion are sealed.

In yet another embodiment of the present invention, the rear cover is connected to a side wall of the other end of the outer case by a hinge so that the rear cover can be rotated relative to the outer case to open or close the other end of the outer case.

In still another embodiment of the present invention, a sliding slot is formed on at least one inner wall surface of the outer case, and a part of the hinge is connected to the rear cover, and another part of the hinge slidably enters into the sliding slot and is fixed in the sliding slot. As such, the rear cover is more convenient to be mounted on the outer case.

According to the present invention, an outer side of the outer case is further provided with a bracket unit, and the outer case can be fixed on an object through the bracket unit.

The foregoing lamp provided by the invention can be opened more easily not only when the lamp needs to be repaired, maintained or changed in the setting of the operation mode, but also the electronic components therein are not adversely affected by the external environment factors, such as moisture, when the lamp is opened. Moreover, water or liquid penetrated into the outer case or water condensed in the outer case can be immediately discharged to avoid damage to the electronic components.

BRIEF DESCRIPTION OF THE DRAWINGS

The present invention is further described below in conjunction with the accompanying drawings and embodiments.

DETAILED DESCRIPTION OF THE PREFERRED EMBODIMENT

The embodiments of the present invention will be described in more detail below with reference to the drawings and the component symbols, so that those skilled in the art can implement the present invention after studying the present specification.

Further, in the following description of the present invention, detailed description of known related art may be omitted to avoid unnecessarily obscuring the subject matter of the present invention.

Figure 1:
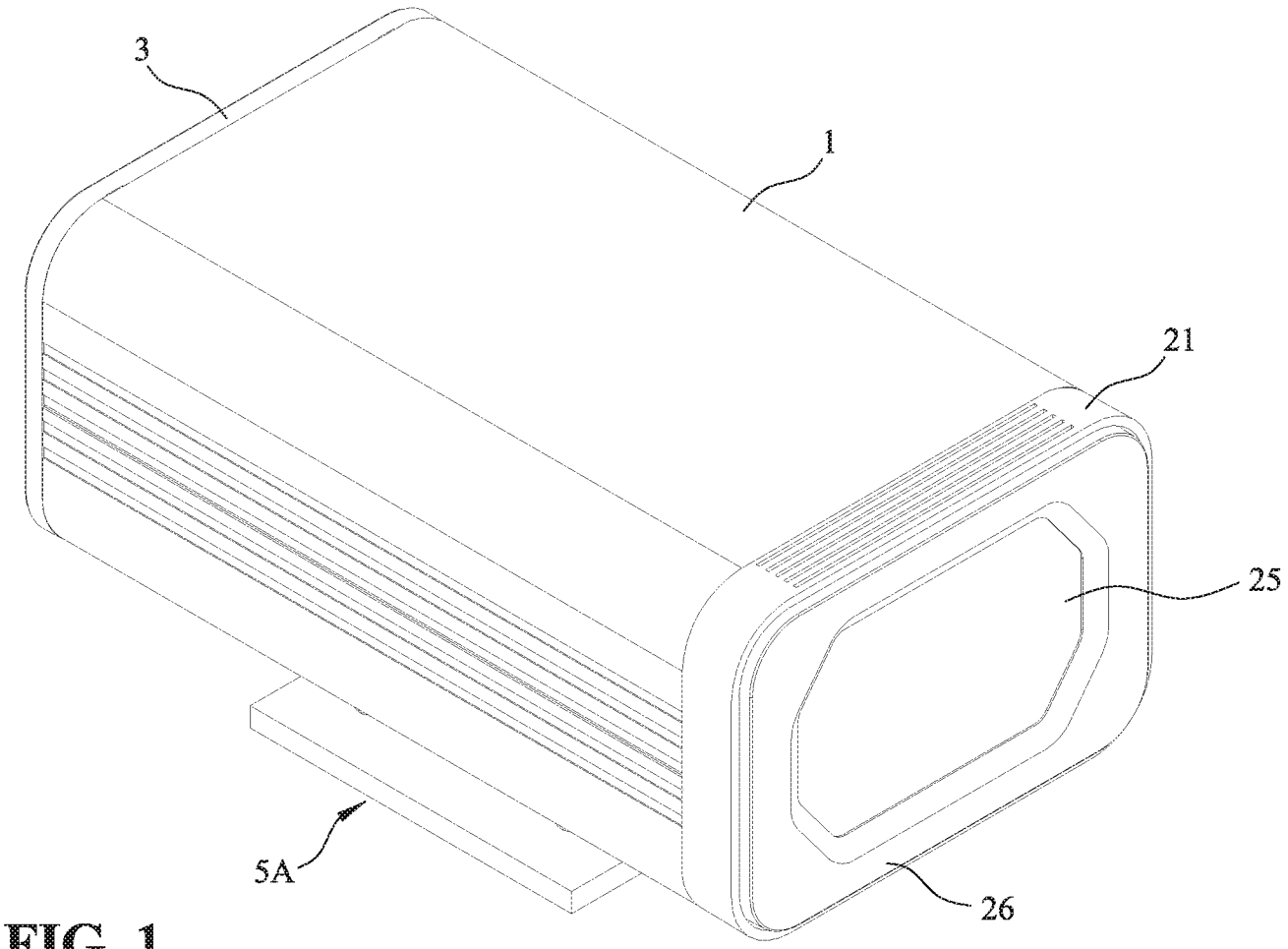
FIG. 1 is a perspective view showing the appearance of the lamp of the present invention.

As shown in FIG. 1, a lamp provided by the present invention is a lamp for lighting, which can be installed indoors or outdoors, such as at a ceiling, a wall or a building. The lamp includes an outer case 1, and a lamp module 2 and a rear cover 3 that are respectively assembled at two opposite ends of the outer case 1. The lamp module 2 is used to project light for illumination, and the rear cover 3 can be opened to repair and maintain the electronic components inside the outer case or change the setting of the operation mode. An inner wall surface of the outer case 1 may form at least one drainage groove 11 that communicates with two opposite ends of the outer case 1, even further, a sliding groove 12 penetrating through the two ends of the outer case 1 may be formed on the inner wall surface of the outer case 1. In particular, the outer case 1 may be integrally formed by extrusion technology so that two drainage grooves 11 having a V-shaped end face are respectively formed on two opposite sides of the inner wall surfaces of the outer case 1, and a sliding groove 12 is formed between the two drainage grooves 11 of the two opposite sides of the inner wall surfaces; accordingly, the drainage grooves 11 are provided on the two opposite sides of the outer case 1, so that either side of the two opposite sides can be used as a bottom of the outer case 1 for drainage, and water or liquid on the inner bottom surface of the outer case 1 can flow into the drainage groove 11 and then be discharged outside.

In another embodiment, the drainage groove 11 is not absolutely necessary, that is, the inner wall surface of the outer case 1 may not be provided with any drainage grooves 11. In the case that the outer case 1 is inclined at an angle, water or liquid on the inner bottom surface of the outer case 1 can also be naturally discharged from a lower end of the outer case 1.

Figure 6:
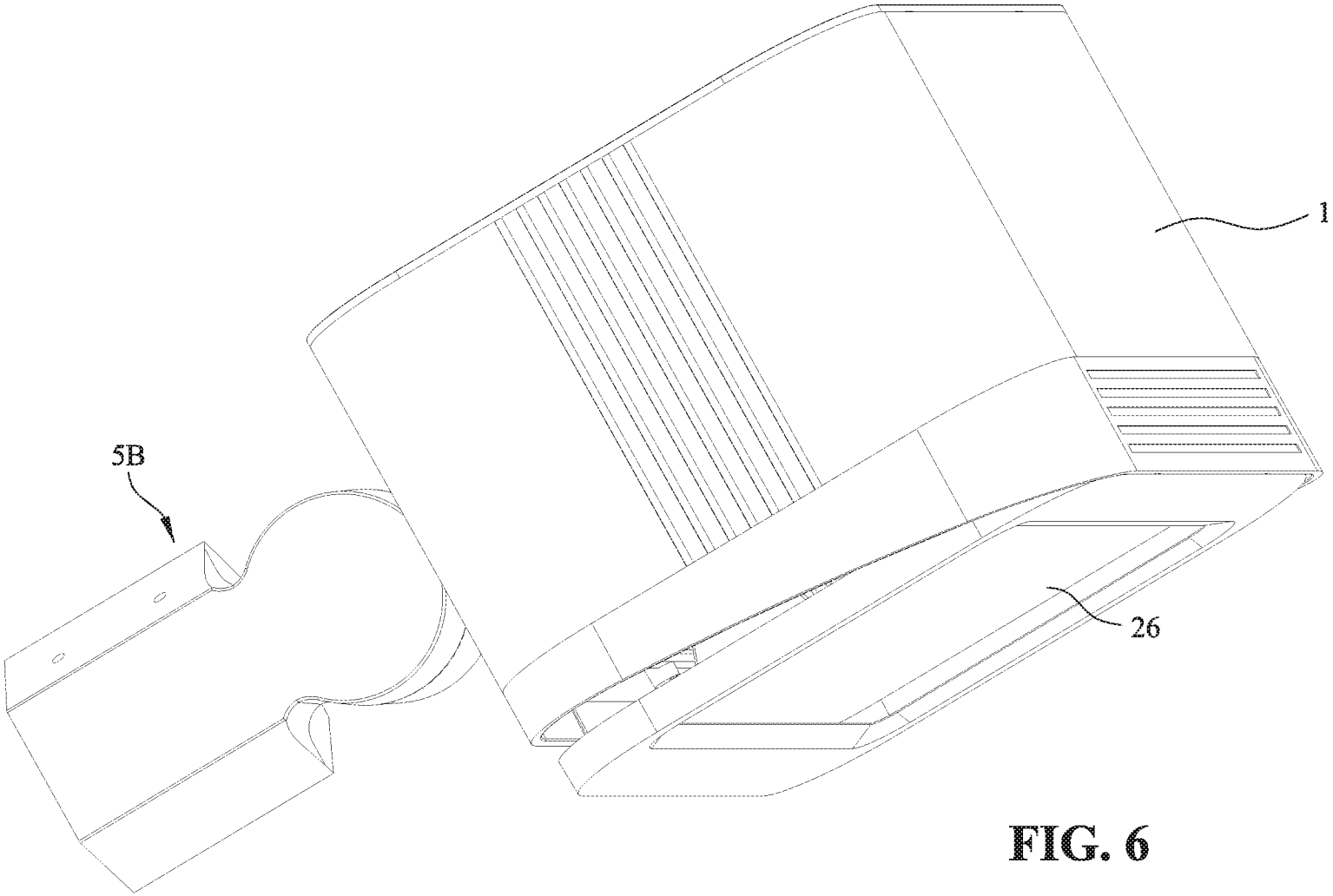
FIG. 6 is a perspective view of another embodiment of the lamp of the present invention.

In addition, the longitudinal length of the outer case 1 need not be limited, and its length can be designed according to actual conditions. As shown in FIG. 6, the outer case 1 has a shorter length.

The lamp module 2 of the present invention substantially includes a heat dissipation case 21 having a mounting portion 212 protruding toward the rear thereof, and the heat dissipation case 21 other than the mounting portion 212 has at least one drainage hole 211. The front side of the mounting portion 212 is used for mounting a light emitting element 22, a reflector 23, a front sealing ring 24, a light-transparent plate 25 and a front cover 26. The front sealing ring 24 is urged between the light-transparent plate 25 and the front circumferences of the mounting portion 212, and the front cover 26 is disposed on the front surface of the light-transparent plate 25 to obtain a sealing effect on the front side of the mounting portion 212. A rear sealing ring 28 and a waterproof cover 27 are disposed at the rear of the mounting portion 212, and the rear sealing ring 28 is located at between the waterproof cover 27 and the rear circumferences of the mounting portion 212, and the waterproof cover 27 is locked to the mounting portion 212 by screws and the rear sealing ring 28 is urged between the waterproof cover 27 and the mounting portion 212 such that the rear of the mounting portion 212 obtains a sealing effect.

More specifically, the heat dissipation case 21 has a frame, and a portion of the outer surface of the frame can be formed with a plurality of fins for absorbing heat and exchanging heat with the air of the external environment. The mounting portion 212 is located around the circumferences of the rear of the frame and protrudes rearward from the frame, and is recessed in front of the frame to form a mounting space 2120. The drainage hole 211 is preferably provided at a position adjacent to the edge of the frame. The reflector 23 can be mounted in the mounting space 2120, and the light emitting element 22 is mounted on a lamp hole reserved by the reflector 23. The light emitting element 22 preferably is an LED light source module. The front sealing ring 24 is correspondingly mounted around the mounting space 2120 in front of the mounting portion 212, and the light-transparent plate 25 (for example, transparent glass) is placed against the front sealing ring 24, and the front cover 26 is screwed to the front of the frame to apply pressure to the light-transparent plate 25, so that the front sealing ring 24 is tightly sealed between the heat dissipating case 21 and the light-transparent plate 25 to prevent water or liquid from penetrating into the mounting space 2120. The conductive wire connected to the light emitting element 22 extends rearward through a central hole (not shown) provided in the center of the waterproof cover 27 and is then connected to an electronic or electrical device disposed in the outer case 1. The central hole and the conductive wire are sealed by a rubber or silicone waterproof ring, and then the heat dissipation case 21 is locked to one end of the outer case 1 so that the drainage hole 211 of the heat dissipation case 21 communicates with the inner space 10 of the outer casing 1. The light emitted from the light emitting element 22 can be reflected by the reflector 23 through the light-transparent plate 25 and the through hole 261 of the front cover 26.

Figure 3:
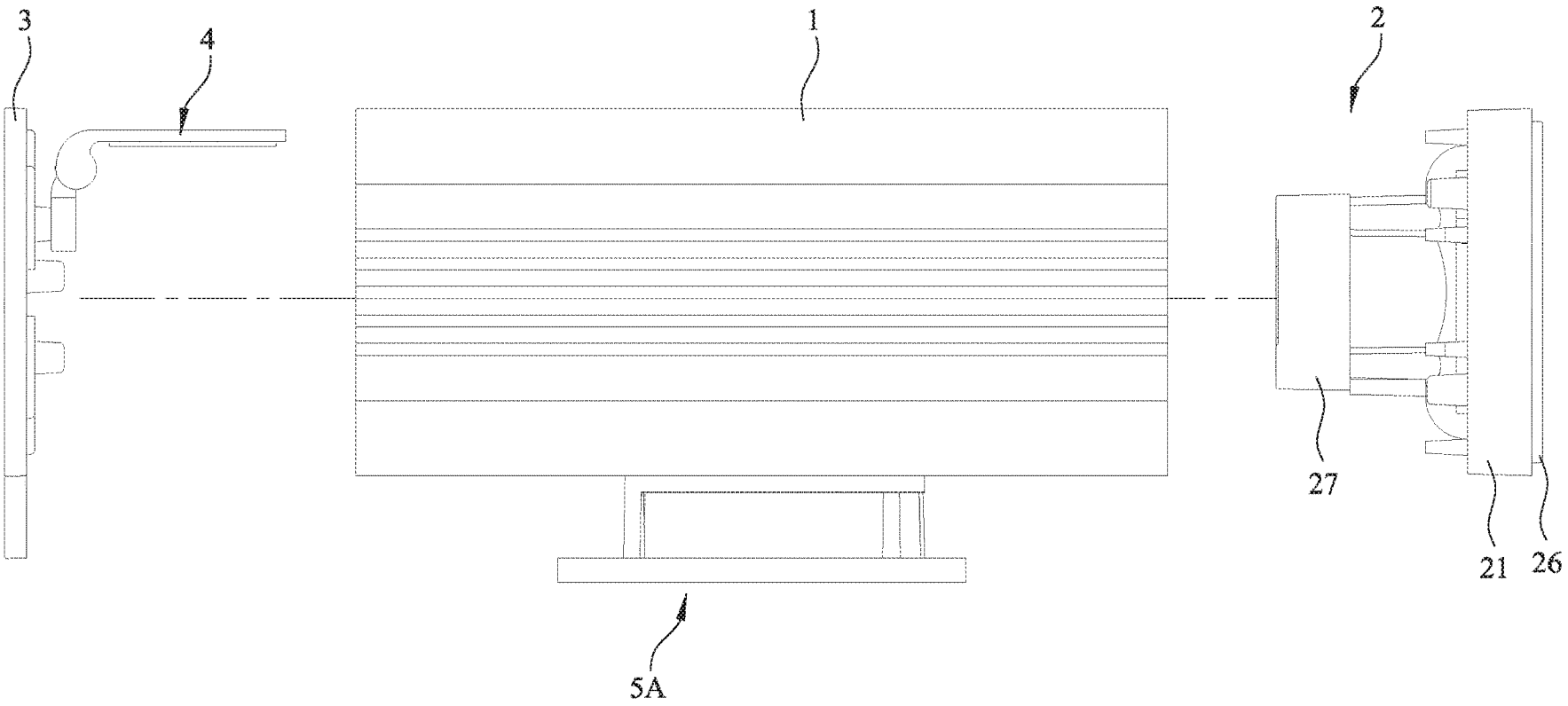
FIG. 3 is an exploded planar view showing an assembling manner that the lamp module and the rear cover of the lamp of the present invention are assembled in the outer case.
Figure 4:
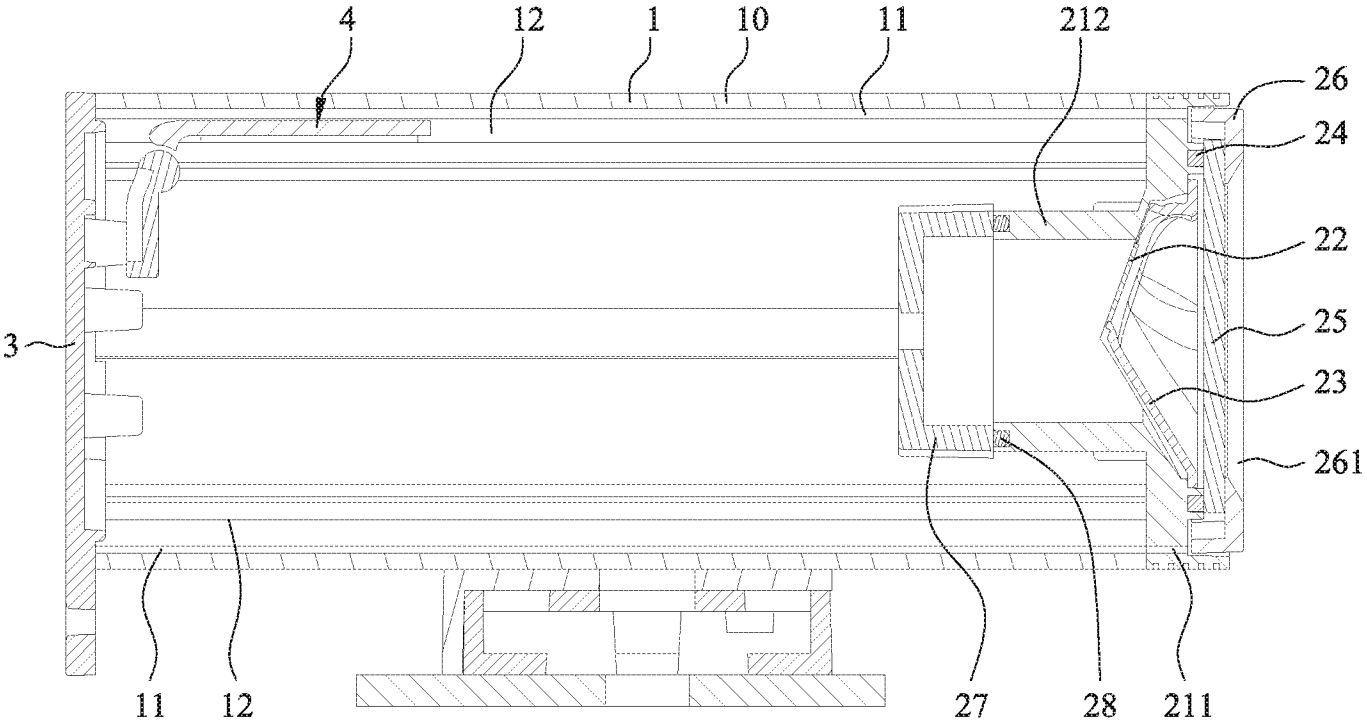
FIG. 4 is a sectional view showing an assemble structure of the lamp of the present invention.
Figure 5:
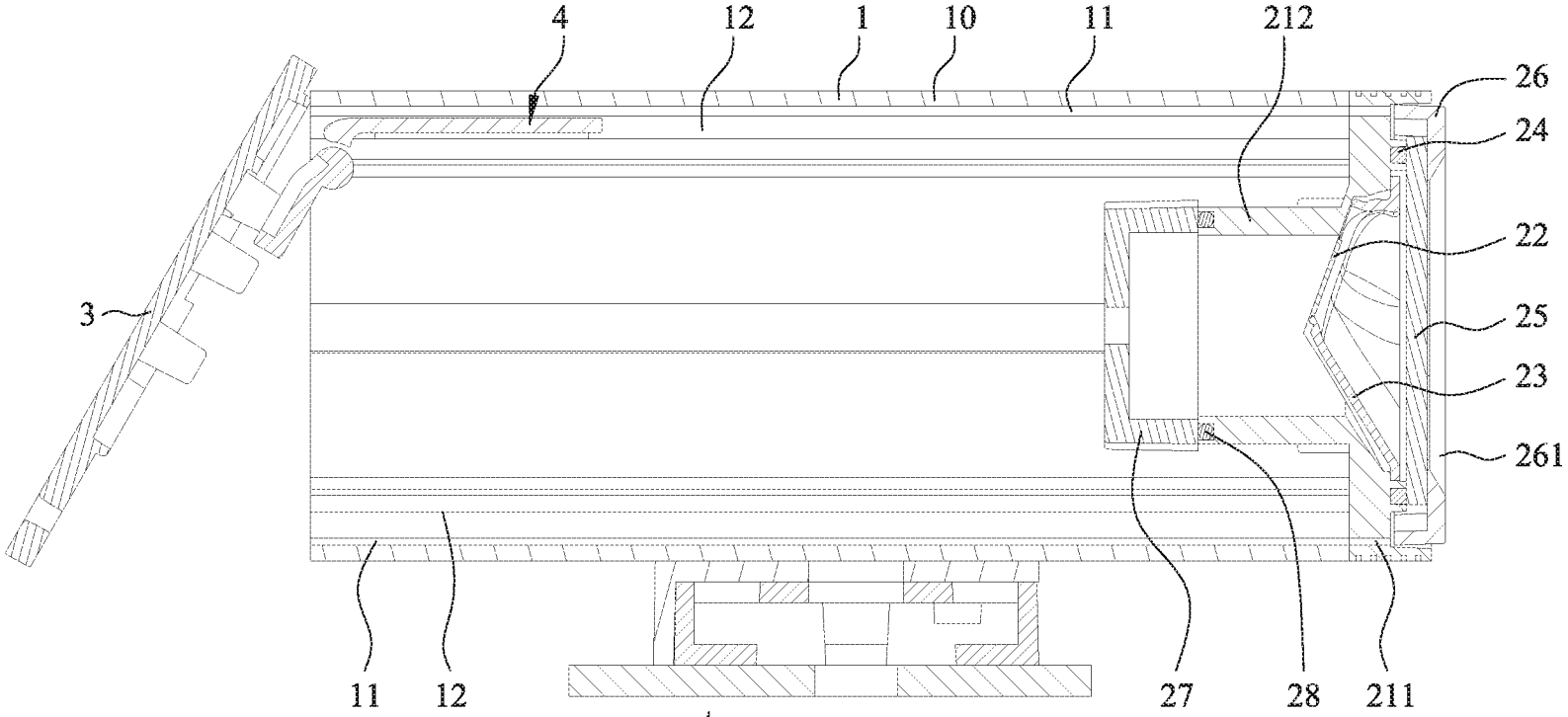
FIG. 5 is a sectional view showing the rear cover of the lamp of the present invention is in an opened state.

The rear cover 3 is attached to a side wall of the other end of the outer case 1 by a hinge 4, so that the rear cover 3 can be rotated relative to the outer case 1 to close or open the other end of the outer case 1. Specifically, according to the present invention, a part of the hinge 4 may be connected and fixed to the rear cover 3, and the other part of the hinge 4 may slidably enter into the sliding slot 12 in the outer case 1 and then the hinge 4 that enters into the sliding slot 12 is locked in the sliding slot 12 (as shown in FIG. 3), so that the rear cover 3 can be rotated relative to the hinge 4 to close the other end of the outer case 1 by the rear cover 3 (as shown in FIG. 4), or the back cover 3 can be opened (as shown in FIG. 5).

Figure 2:
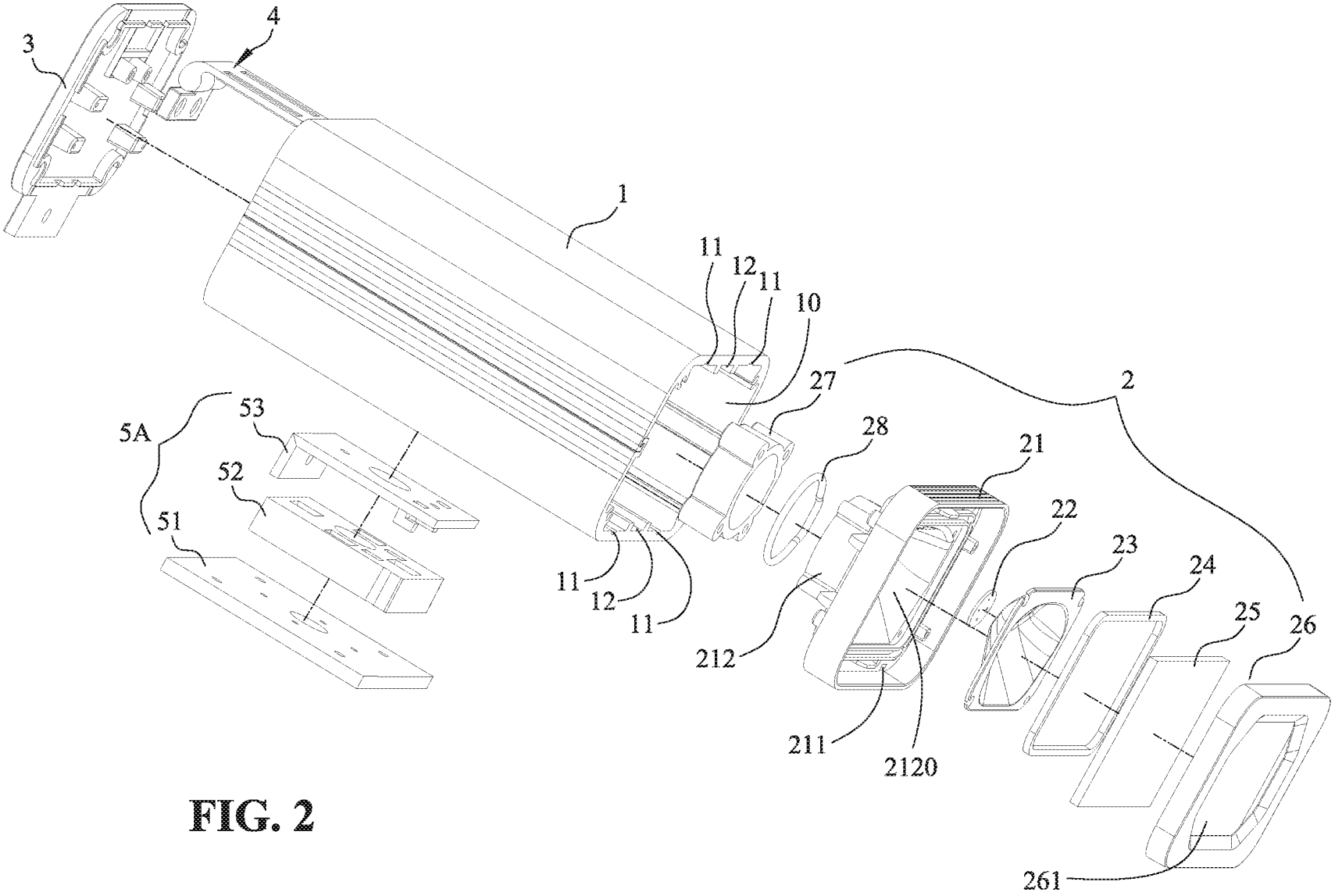
FIG. 2 is an exploded perspective view showing the structure of main components of the lamp of the present invention and the assembling relationship thereof.

In addition, in order to enable the lamp to be mounted on an object such as a ceiling, a wall or the like, the present invention may also provide a fixed bracket unit 5A (shown in FIG. 2) on the outside of the outer case 1. The outer case 1 can be fixedly placed on the object through the bracket unit 5A. For example, the fixed bracket unit 5A may include a fixing plate 51, a lower bracket 52 and an upper bracket 53, wherein the fixing plate 51 is fixed on the object, the lower bracket 52 is mounted on the fixing plate 51, and the upper bracket 53 is mounted on the lower bracket 52.

In another embodiment, the present invention may also replace the aforementioned fixed bracket unit 5A with a movable bracket unit 5B (see FIG. 6) having a rotatable joint. After the lamp is mounted on the object through the movable bracket unit 5B, the angle and position of the illumination can be adjusted by rotating the joint. Since the movable bracket unit 5B is not the key point of the present invention, the detailed description of the structure is omitted herein.

In the present invention, since the sensitive electronic components and the light emitting element 22 such as an LED are independently sealed in the mounting portion 212 of the lamp module 2, Therefore, the lamp module 2 does not need to be disassembled unless the light emitting element 22 fails to be replaced. When it is necessary to periodically repair, maintain, or change the setting of the operation mode (for example, it is changed to the wireless control mode), the worker can operate the electronic and electrical equipment disposed in the inner space 10 of the outer case 1 by simply opening the rear cover 3. After the repair is completed, the rear cover 3 is closed. The sensitive electronic components are not exposed to the outside during the maintenance process, thereby preventing from the adverse effects of external environmental factors, and thus prolonging the service life.

Furthermore, since the lamp of the present invention is usually installed at a high position for lighting down, the outer side of the lamp module 2 is mounted at a low position. When the rain water or other liquid penetrates into the outer case 1, the water or the liquid may first flow into the drainage groove 11 and then be discharged through the drainage hole 211, or may naturally be discharged through the drainage hole 211 when the drainage groove is not provided, so that the inner space 10 of the outer case 1 is kept dry frequently. That can avoid the adverse effects of moisture on the electronic and electrical equipment.

The above description is only for explaining the preferred embodiments of the present invention, and is not intended to limit the present invention. Therefore, any form of the changes should be included in the scope of the invention as claimed.

What is claimed is:

1. A lamp with a drainage channel, comprising:

an outer case having an inner space extending through two opposite ends of the outer case, and an inner wall surface of the outer case forms at least one drainage groove that communicates with the two opposite ends of the outer case;

a lamp module including a heat dissipation case having a mounting portion, wherein at least one light emitting elements and a reflector are sealingly mounted in the mounting portion, the heat dissipation case other than the mounting portion is provided with at least one drainage hole, and the lamp module is assembled at one end of the outer case so that the drainage hole is communicated with the inner space; and a rear cover pivotally coupled to the other end of the outer case such that the other end of the outer case can be closed or opened by the rear coven, wherein, when the lamp module is mounted on the outer case, the drainage groove is linearly corresponding to the drainage hole.

2. The lamp of claim 1, wherein the heat dissipating case has a frame, and the mounting portion is located around a periphery of the frame to form a mounting space, and the drainage hole is disposed at a position adjacent to an edge of the frame.

3. The lamp of claim 1, wherein the heat dissipating case has a frame, and the mounting portion is located around a periphery of the frame and forms a mounting space, and the drainage hole is disposed at a position adjacent to an edge of the frame.

4. The lamp of claim 1, wherein the drainage groove is integrally formed to be recessed toward an inner wall surface of the outer case.

5. The lamp of claim 1, wherein the light emitting element, the reflector, a front sealing ring, a light-transparent plate and a front cover are mounted on a front side of the mounting portion, wherein the front sealing ring is urged between the light-transparent plate and a front periphery of the mounting portion and the front cover is assembled in front of the light transparent plate, and a rear sealing ring and a waterproof cover are mounted behind the mounting portion, and the rear sealing ring is urged between the waterproof cover and a rear periphery of the mounting portion.

6. The lamp of claim 1, wherein the rear cover is connected to a side wall of the other end of the outer case by a hinge.

7. The lamp of claim 6, wherein a sliding slot is formed on at least one inner wall surface of the outer case, and a part of the hinge is connected to the rear cover, and another part of the hinge slidably enters into the sliding slot and is fixed in the sliding slot.

8. The lamp of claim 1, wherein an outer side of the outer case is provided with a bracket unit, and the outer case can be fixed on an object through the bracket unit.

* * * * *